US011656065B2

(12) United States Patent
Larsson et al.

(10) Patent No.: US 11,656,065 B2
(45) Date of Patent: May 23, 2023

(54) METHOD AND SYSTEM FOR INDUCTIVE PROGRAMMING OF A FUZE

(71) Applicant: BAE SYSTEMS BOFORS AB, Karlskoga (SE)

(72) Inventors: Jonas Larsson, Kristinehamn (SE); Mikael Olsson, Karlskoga (SE); Thomas Särnmar, Degerfors (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 11 days.

(21) Appl. No.: 17/352,260

(22) Filed: Jun. 19, 2021

(65) Prior Publication Data

US 2021/0310778 A1 Oct. 7, 2021

Related U.S. Application Data

(63) Continuation of application No. 16/647,975, filed as application No. PCT/SE2018/050925 on Sep. 12, 2018, now Pat. No. 11,060,830.

(30) Foreign Application Priority Data

Sep. 28, 2017 (SE) ..... 1700228-8

(51) Int. Cl.
*F42C 17/04* (2006.01)

(52) U.S. Cl.
CPC ..... *F42C 17/04* (2013.01)

(58) Field of Classification Search
CPC ..... F42C 17/04; F42C 17/00
USPC ..... 89/6, 6.5
See application file for complete search history.

(56) References Cited

U.S. PATENT DOCUMENTS 6,289,780 B1 * 9/2001 Heldmann ..... F42C 17/04 89/6
8,490,533 B2 * 7/2013 Reynard ..... F42C 11/04 89/6
11,060,830 B2 * 7/2021 Larsson ..... F41A 9/22

FOREIGN PATENT DOCUMENTS

FR 2704312 A1 10/1994

OTHER PUBLICATIONS

European Search Report (dated May 21, 2021) for corresponding European App. ep 18 86 2385.

* cited by examiner

*Primary Examiner* — Reginald S Tillman, Jr.
(74) *Attorney, Agent, or Firm* — WRB-IP PLLC

(57) ABSTRACT

A method and a system for inductively programming a fuze including at least one target coil arranged in a projectile by a fuze setter including at least one setter coil, the method including i) conveying at least one of a projectile or a fuze setter by an actuator to bring the at least one target coil and the at least one setter coil in an inductive coupling position,
ii) programming the fuze by transferring predetermined fuzing data from the at least one setter coil to the at least one target coil,
iii) optionally transferring fuzing data from the at least one target coil to the at least one setter coil to confirm correct programming of the fuze has been performed, and
iv) retracting at least one of the fuze setter or projectile from the inductive coupling position when the transfer of fuzing data has been completed.

18 Claims, 7 Drawing Sheets

METHOD AND SYSTEM FOR INDUCTIVE PROGRAMMING OF A FUZE

BACKGROUND AND SUMMARY

The present invention relates to a system and a method for inductively programming a projectile. The invention also relates to the use of such system for inductive programming in a weapon system.

Hand-held fuze setters for inductively programming projectiles are known in the art. Inductive fuze setters operate by transmitting data such as time-of-flight, time-to-burst, target coordinates etc. to a fuze comprised in a programmable projectile. An example of a hand-held fuze setter is the Enhanced Portable Inductive Artillery Fuze Setter (EPIAFS).

When programming a fuze, it is important to enable quick and reliable transmission of data while safeguarding that the fuze has received the intended transmitted data correctly.

Hand-held setters may be readily moved but cannot be employed in rapid fire weaponry operations due to the time-consuming procedure of programming manual operation procedure of each projectile. Moreover, previous solutions have involved programming at a late stage just prior to firing. Such late just-in-time programming has resulted in a low fire capability.

It would be desirable to increase the rapid fire capability for programmable projectiles in order to reduce counterfire risks while ensuring that safe and correct programming is achieved. In particular, it is desirable to provide a method which safeguards firing of already programmed projectiles which thus omits a delaying programming stage after having conveyed the projectiles from the magazine to the weapon. The present invention intends to solve these problems encountered in prior art. Moreover, it is desirable to obtain an efficient coupling coefficient.

The present invention relates, according to an aspect thereof, to a method of inductively programming a fuze comprising at least one target coil arranged in a projectile by means of a fuze setter comprising at least one setter coil, said method comprising i) conveying at least one of a projectile or a fuze setter by means of actuating means to bring said at least one target coil and said at least one setter coil in an inductive coupling position, ii) programming the fuze by transferring predetermined fuzing data from said at least one setter coil to said at least one target coil iii) optionally transferring fuzing data from said at least one target coil to said at least one setter coil to confirm correct programming of the fuze has been performed iv) retracting at least one of said fuze setter or projectile from said inductive coupling position when the transfer of fuzing data has been completed.

According to one embodiment, the inductive programming is performed in a magazine.

For reasons of simplicity, by the term "coil" when mentioned in the context of a target coil or a setter coil is meant at least one target coil or at least one setter coil.

According to one embodiment, said at least one setter coil transfers electrical energy to said at least one target coil. According to one embodiment, said fuze setter and fuze are concentrically positioned in said inductive coupling position. According to one embodiment, said at least one setter coil embraces said at least one target coil in said inductive coupling position. According to one embodiment, the setter coil is retracted subsequent to completion of transfer of the fuzing data. According to one embodiment, said actuating means is powered by means of a hydraulic system H. According to one embodiment, said at least one setter coil and/or target coil is conveyed substantially horizontally to the inductive coupling position. According to one embodiment, the projectile is positioned in a magazine, preferably in a holder of the magazine, prior to and during programming of the fuze. According to one embodiment, programmed projectiles are stored in the magazine. Preferably, programmed projectiles are stored in the magazine prior to loading. Preferably, when the transfer of predetermined fuzing data has been completed, the programmed projectile comprising the fuze is ejected from the magazine, preferably from the holder of a magazine. According to one embodiment, the projectile is positioned with its nose portion horizontally in a horizontal holder in a magazine. According to one embodiment, at least one sensor, preferably a proximity sensor, is arranged to monitor conveying of at least one of the fuze setter or the projectile to provide said inductive coupling position. By use of such sensor, any projectile independent of its size may be correctly guided to obtain optimal inductive coupling. According to one embodiment, a gun computer program monitors the actuating means. According to one embodiment, the projectile is transported by means of actuating means comprising a guiding arrangement to an inductive coupling position.

The invention also relates, according to another aspect thereof, to a system for inductively programming a fuze comprising a. a fuze setter comprising at least one setter coil operable to transfer fuzing data to a fuze b. a fuze comprising at least one target coil in a projectile adapted to receive fuzing data from fuze setter and optionally operable to send fuzing data back to the setter coil, c. optionally a magazine provided with at least one holder for at least one projectile in which a) and b) are positioned along a common center line d. actuating means operable to convey at least one of a) or b) to an inductive coupling position.

According to one embodiment, a) is conveyable by the actuating means to allow for an inductive coupling with b). According to one embodiment, b) is conveyable by the actuating means to allow for an inductive coupling with a). According to one embodiment, the actuating means are operable to convey the fuze setter and/or the projectile substantially horizontally to an inductive coupling position. According to one embodiment, the actuating means is a hydraulic, pneumatic or an electrical actuator.

The invention also relates, according to yet another aspect thereof, to an artillery system comprising the system as defined herein.

Preferably, the fuze setter comprises a controller connected to a transmitter and a receiver, the transmitter and the receiver each being electrically connected to at least one setter coil.

Preferably, the fuze includes electronic circuitry for sending a talkback or acknowledge message back to the fuze setter, preferably back to a controller comprised in a fuze setter system to confirm transmitted data has been correctly transferred.

Preferably, the setter coil receives fuzing data which is subsequently transmitted to the electronic circuitry comprised in the fuze. Preferably, the electronic circuitry comprised in the fuze may excite and modulate an electric signal that is electrically connected to the target coil whereby the target coil may inductively transmit data back to the setter coil. Various standards governing communication between fuze setter and fuze are available, e.g. a 100 kHz carrier signal which is pulse width modulated (PWM) for forward message transmitting data, e.g. detonation data, to the fuze and a pulse code modulated (PCM) signal for the reverse or talkback message whereby the fuze may confirm the transmitted data. Other modulation types suitable for inductive communication could also be utilized such as pulse amplitude modulation or pulse position modulation.

Preferably, the inductive coupling between the fuze setter and the fuze allows also for energy transfer from the fuze setter to the fuze. The energy transferred from the fuze setter to the fuze could be stored in a battery, capacitor or other energy storage device arranged in the fuze electronics.

Preferably, the projectile comprises a body, a payload, and a fuze comprising a target system including a target coil for affecting operation of the projectile and fuze electronics for receiving and transmitting information to and from the target coil.

According to one embodiment, the projectile may be any type of projectile including artillery shells, missiles, rockets, bombs, torpedoes etc. The projectile may be powered or unpowered. Preferably, the body of the projectile is substantially cylindrical with a tapered nose portion.

According to one embodiment, the payload that may be carried in the body of the projectile includes explosives, warhead, guidance system, and/or communication system. Preferably, the at least one target coil of the projectile is electrically coupled to electric circuitry within the fuze. Preferably, the target coil and the electronic circuitry comprised make up a target system.

Preferably, the fuze setter includes at least one setter coil arranged in the nose portion of the fuze setter, for example in a nose portion adapter. Preferably, a nose portion adapter is designed to engage the nose portion of the projectile in such a way to enable positioning of the at least one setter coil in close proximity to the target coil to allow for inductive coupling. Preferably, the nose portion adapter of the setter coil includes a conically shaped cavity into which the nose portion of the projectile is inserted to transmit and/or conduct data and/or power transfer.

Preferably, the at least one setter coil is electrically coupled to setter electronics included in a setter system. The setter electronics and the electronical circuitry of the fuze are designed to communicate with each other when inductively coupled via the target coil and the setter coil.

Preferably, the setter system comprises setter electronics and said at least one setter coil. Preferably, the setter electronics includes a power driver for delivering power to the target system inductively via the setter coil. Preferably, the setter electronics includes a data driver for providing operational data to the target system. Preferably, a data receiver for receiving data from the target system is provided in which the target system communicates back to the setter system. For example, the target system may transmit status information or data verification to the setter system. Preferably, the setter electronics further includes control logic for controlling various operations within the setter system. Preferably, the setter electronics includes a power supply for providing operating power to the setter system.

The target system preferably comprises said at least one target coil and electronic circuitry. Preferably, the electronic circuitry of the target system comprises a power receiver for receiving power from an inductively coupled power driver via the target coil. Preferably, the electronic circuitry of the target system includes a data driver for providing response data to the setter system via the target coil. Preferably, the target system includes control logic for controlling the operation within the target system.

According to one embodiment, multiple coils are used, for example, plural coils are being used, for example a pair of coils is used in the setter system and the target system.

Preferably, the fuze setter is secured to a guiding arrangement arranged to convey the fuze setter to a fuze for programming thereof. Preferably, the guiding arrangement is, by means of actuating means, arranged to be conveyed in a horizontal direction, preferably linearly to the fuze for inductive coupling therewith. Preferably, the guiding arrangement may be conveyed by means of rails or other guiding means conveying the guiding arrangement to the fuze. According to one embodiment, the guiding arrangement is arranged to be horizontally movable along a horizontal holder, preferably a horizontal holder arranged in a magazine, for projectiles whereby the guiding arrangement may be horizontally conveyed along the holder to reach an inductive coupling position for performing the necessary transfer of data. According to one embodiment, the guiding arrangement conveying the fuze setter is movably secured to a horizontally arranged rail in an upper portion of the holder for projectiles. In this manner, the fuze setter may be horizontally conveyed from a starting point, e.g. at one end of the holder towards a projectile to be programmed e.g. at another end of the holder. Preferably, the guiding means of the arrangement is allowed to slide along a slot of the guiding means in contact with the rail for smooth and safe conveying to the projectile. In such manner, the fuze setter secured to the guiding arrangement is brought to a position for inductive coupling with the target coil of the projectile.

Preferably, the setter coil of the fuze setter and the target fuze comprised in the projectile are positioned concentrically when inductively coupled. Preferably, the fuze setter is transported substantially horizontally along a common center line of the fuze setter and the target coil by means of the guiding arrangement.

According to one embodiment, a guiding arrangement is provided to convey the projectile to the fuze setter for inductive coupling thereof. The guiding arrangement of the projectile can be either a separate guiding arrangement or constitute a part of a guiding arrangement conveying the fuze setter. According to one embodiment, the guiding arrangement is provided with separate guiding means for the projectile which may convey the projectile to the fuze setter for programming of the fuze. Preferably, such guiding means are arranged to convey the projectile in a horizontal direction towards the fuze setter. If a separate guiding arrangement is provided for conveying the projectile, separate actuating means may control the conveying of the projectile. According to one embodiment, both the fuze setter and the projectile are conveyed to one another by means of actuating means for inductive coupling and programming of the projectile. Preferably, conveying of the fuze setter and/or the projectile is made substantially horizontally. If the programming is performed in a magazine, depending on the type of magazine, conveyance may be performed in other directions than horizontally, for example vertically or both horizontally and vertically. According to one embodiment, a control system comprising at least one sensor is provided to monitor the conveyance of the fuze setter coil and/or the target coil. Preferably, such sensor, e.g. proximity sensor, may be adapted to monitor accurate inductive coupling of the fuze setter and projectile fuze. Preferably, such sensor may also safeguard the fuze setter does not cause any damage to the projectile, e.g. by controlling that a predetermined pressure exerted by the fuze setter on the projectile is not exceeded. Preferably, prior to inductive coupling, the setter coil is positioned at one end of a holder for at least one projectile in a magazine so as to enable smooth horizontal transport thereof to the programmable projectile. Preferably, the programmed projectile is subsequently conveyed to a loading tray for subsequent loading in a firearm.

According to one embodiment, the programming of the fuze could also be performed outside a magazine, for example before the projectile is rammed or prepared to be fired and/or when the projectile is arranged in a loading tray.

According to one embodiment, if programming is performed in a magazine, the magazine comprises a plurality of holders for projectiles arranged in a drivable revolving track. Preferably, the holders are arranged to assume feed-in and feed-out positions for the feed-in and feed-out of at least one projectile to and from the holders. Preferably, the magazine is provided with a control unit arranged to actuate the driving of the revolving track for positioning of at least one holder to the said feed-in and feed-out positions. Preferably, the revolving track comprises a chain conveyor and a driving device comprising a hydraulic motor.

Preferably, the magazine comprises at least one ejection member, which ejection member, in response to control signals from a control unit, ejects one or more projectiles from the respective holder, applied in the feed-out position, to a loading tray belonging to the gun.

Preferably, the holder in the magazine is arranged with an openable and closable first opening, which, when the projectile is applied in the feed-in position of the magazine, is essentially directed upwards to enable a projectile to be deposited in the holder.

Preferably, the holder is arranged, when a projectile is fed out from the holder to a loading tray of the gun, to have an opening facing towards the loading tray, which opening consists of or comprises a second opening arranged on the opposite side to the first opening.

Preferably, the feed-in position is positioned in a protected part of the gun. Preferably, the feed-out position is positioned in an unprotected part of the gun. Preferably, the holders are provided with openable and closable hatch parts.

Preferably, the ejection member comprises a hydraulic cylinder which ejects or the respective projectiles, preferably in a longitudinal direction perpendicular to the holder.

According to one embodiment, the actuating means is powered by means of fluidic system, e.g. pneumatics or hydraulics whereby the setter coil and/or projectile is transported to an inductive coupling position for transferring and receiving information and/or energy.

Communication governed by a gun computer system may be performed according to any conventional standard. A communication scheme as referred to in e.g. U.S. Pat. No. 6,176,168 may be used. Any suitable magazine type may be used, for example as further disclosed in WO2011/049503.

DETAILED DESCRIPTION

Figure 1:
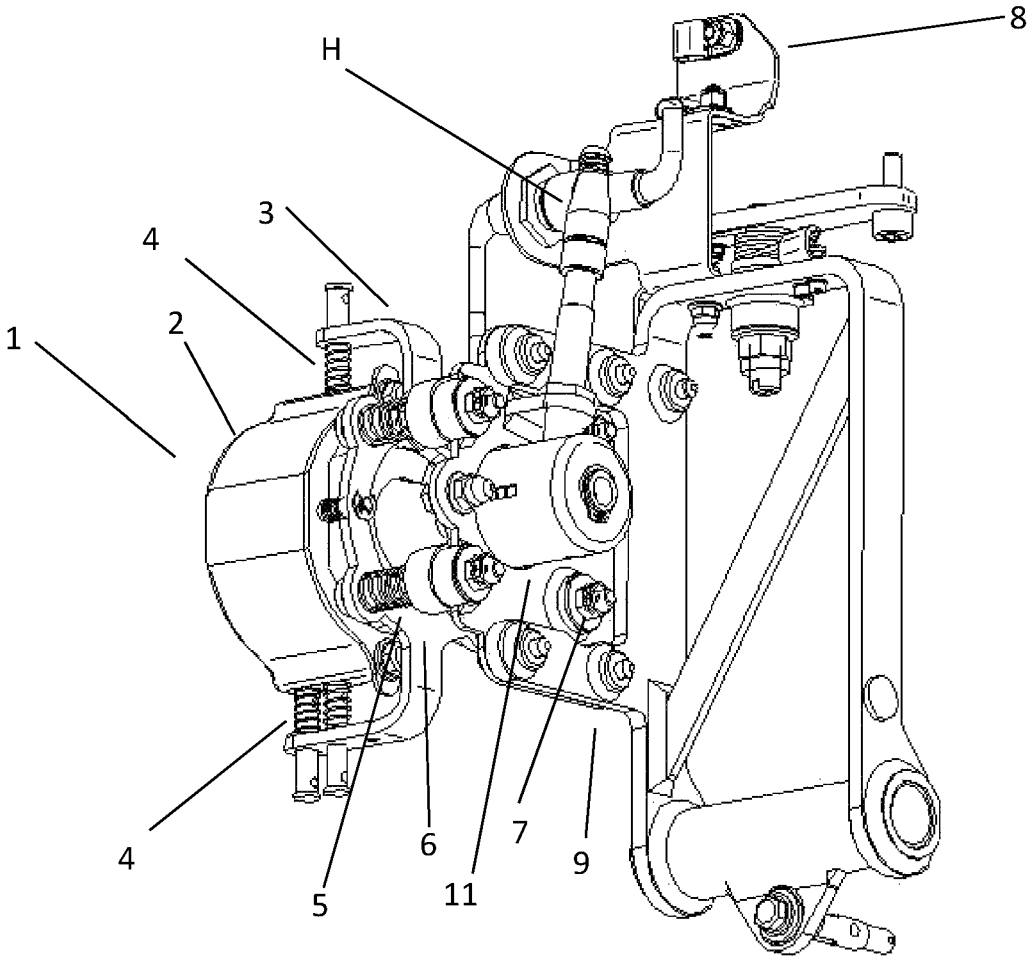
FIG. 1 shows a side view diagonally from the back of the guiding arrangement and the fuze setter.

FIG. 1 shows a side view from the back of a guiding arrangement 1 for substantially horizontal transport of a fuze setter 2 (rear side thereof is shown) being suspended in resilient means 4 attached to holder device 3. Resilient means 4 could for example be different types of springs such as coil springs. The fuze setter 2 is further secured by horizontally arranged resilient means 5 which in turn are fixed to a vertical portion 6 of holder device 3. The vertical portion 6 is fixedly arranged to a co-planar element 9 by bolts 7. Guiding means 8 slidable along rail 10 (shown in FIG. 3) are in turn mechanically connected to element 9 by bolts. Guiding means 8 provide for slidable transport along rail 10. The guiding means 8 may be provided with slots or the like providing for smooth gliding along the rail 10. A lower portion of the guiding arrangement 8 is secured to the magazine safeguarding the fuze setter can be conveyed horizontally to an inductively coupled position. A hydraulic system H powering actuating means 12 for conveying the fuze setter may be provided. The actuating means could for example be a hydraulic cylinder.

Figure 2:
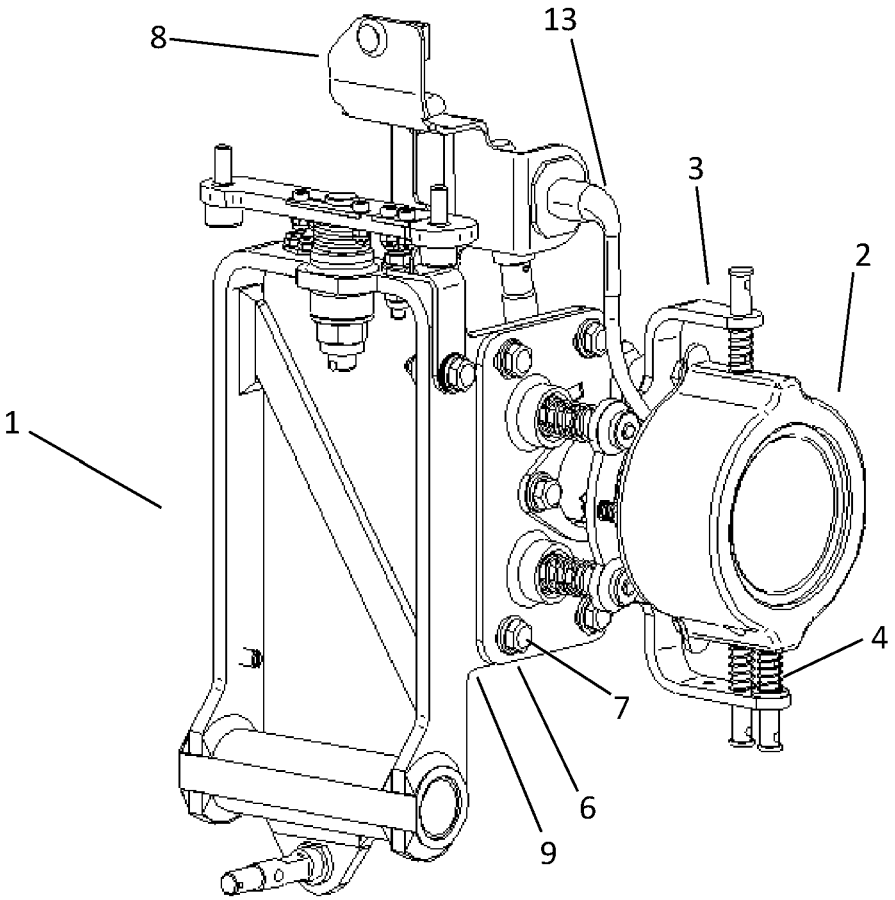
FIG. 2 shows a side view of the guiding arrangement including the fuze setter facing the projectile.

FIG. 2 shows a side view of the guiding arrangement 1 and the fuze setter 2. The fuze setter 2 is electrically connected via a cable 13 to setter electronics mounted in a setter electronics box (not shown) on the exterior of the magazine housing.

Figure 3:
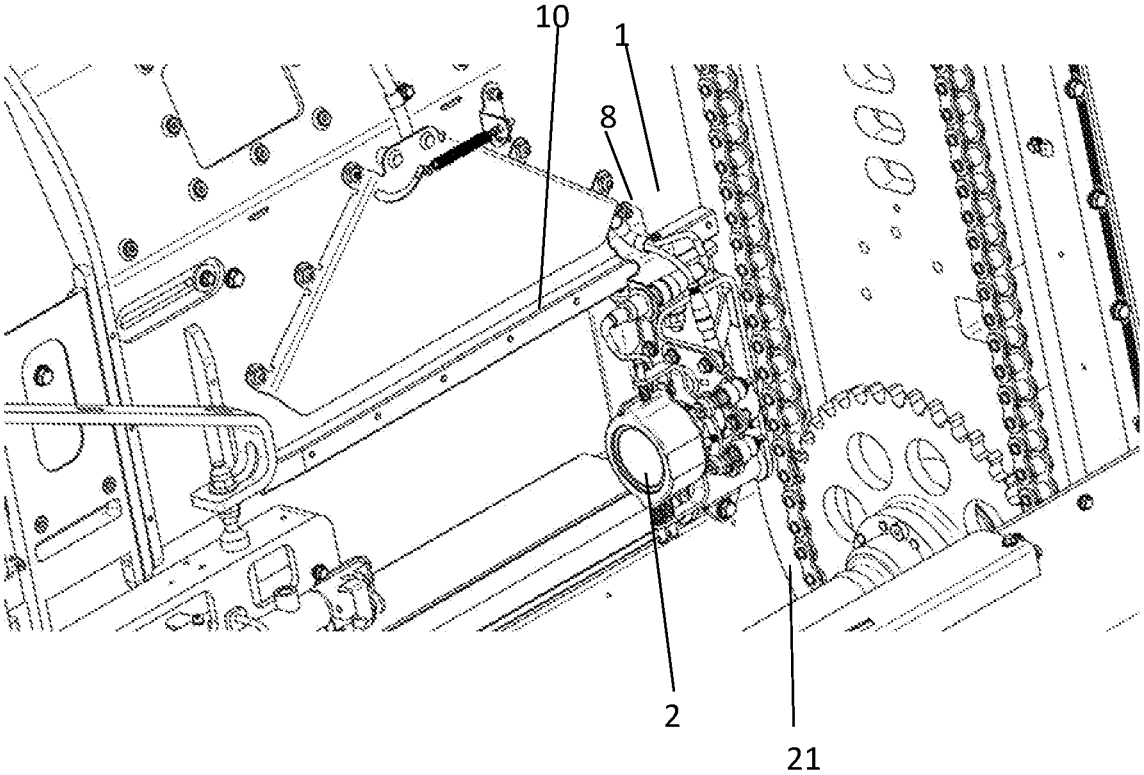
FIG. 3 shows the guiding arrangement arranged in a magazine comprising an arrangement for feeding projectiles to a position for subsequent programming thereof.

FIG. 3 shows the guiding arrangement 1 comprising guiding means 8 conveying fuze setter 2 along a rail 10 arranged inside the magazine. Thereby, the fuze setter 2 can be transported substantially horizontally along rail 10 to a projectile 110 (not shown) for inductive coupling. Guiding arrangements for transporting a projectile 110 to a fuze setter 2 may also be arranged. Such arrangement may in a similar manner transport the projectile 110 to the fuze setter 2 whereby the projectile 110 is conveyed along a rail 10 so as to arrive at an inductive coupling position. Combined guiding arrangements may also be provided wherein both the projectile 110 and the fuze setter 2 are conveyed to an inductive coupling position. FIG. 3 also illustrates a chain and sprocket 21 for moving projectiles arranged in holders in a magazine and thus for moving a projectile 110, arranged in a holder, to a position for programming.

Figure 4:
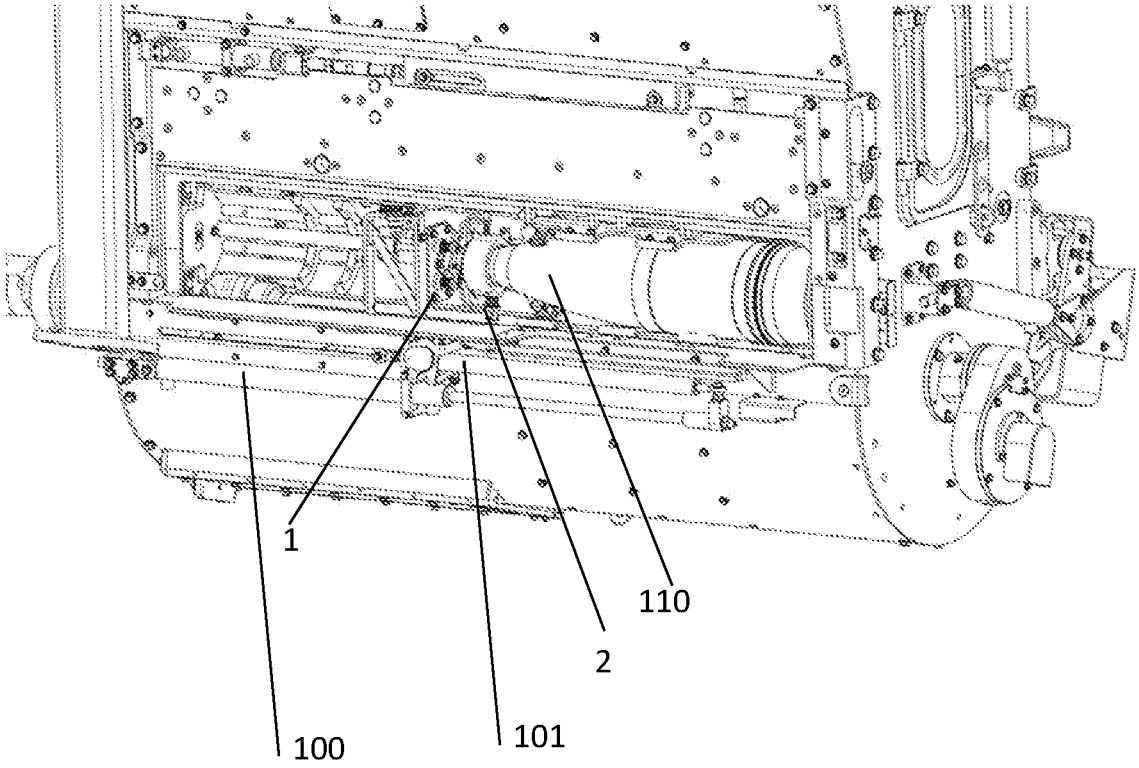
FIG. 4 shows a portion of a magazine comprising the guiding arrangement and a projectile docketed to a fuze setter in an inductive coupling position.

FIG. 4 shows a side view of a guiding arrangement 1 including the fuze setter 2 and projectile 110 when the fuze setter 2 is arranged to program the fuze of the projectile 110. A first actuator 100 and a second actuator 101 are arranged to move the guiding arrangement 1 by guiding means 8 along a rail 10 (cf. FIG. 2). The fuze setter 2 is coaxially arranged around the fuze of the projectile 110 to be programmed. The holder device 3 and fuze setter 2 are movably arranged relative to the co-planar surface 9 (cf. FIG. 1) to adapt their positions relative to the projectile 110 to be programmed. At the programming position, the fuze setter 2 contacts or is positioned close to the fuze of the projectile 110. In order to control the exact position of the fuze setter 2, especially when approaching and reaching its programming position, at least one sensor is suitably monitoring the fuze setter 2 which when reaching its correct position is brought to a standstill, e.g. by means of a feedback control system of the first actuator and the second actuator to stop the movement when a predetermined pressure is exerted by the fuze setter 2 on the fuze of the projectile 110. When the fuze setter 2 is correctly positioned for programming, programming of the fuze of the projectile 110 is initiated. In the case electrical energy should be supplied to the projectile 110, energy is transferred inductively from the fuze setter 2 to the target coil arranged in the fuze of the projectile 110. The energy received by the target coil is stored in a capacitor or other energy storage component and used to power the electronics of the fuze electronics completely or partly, for example during programming and after programming when the projectile is fired from the gun.

Figure 5:
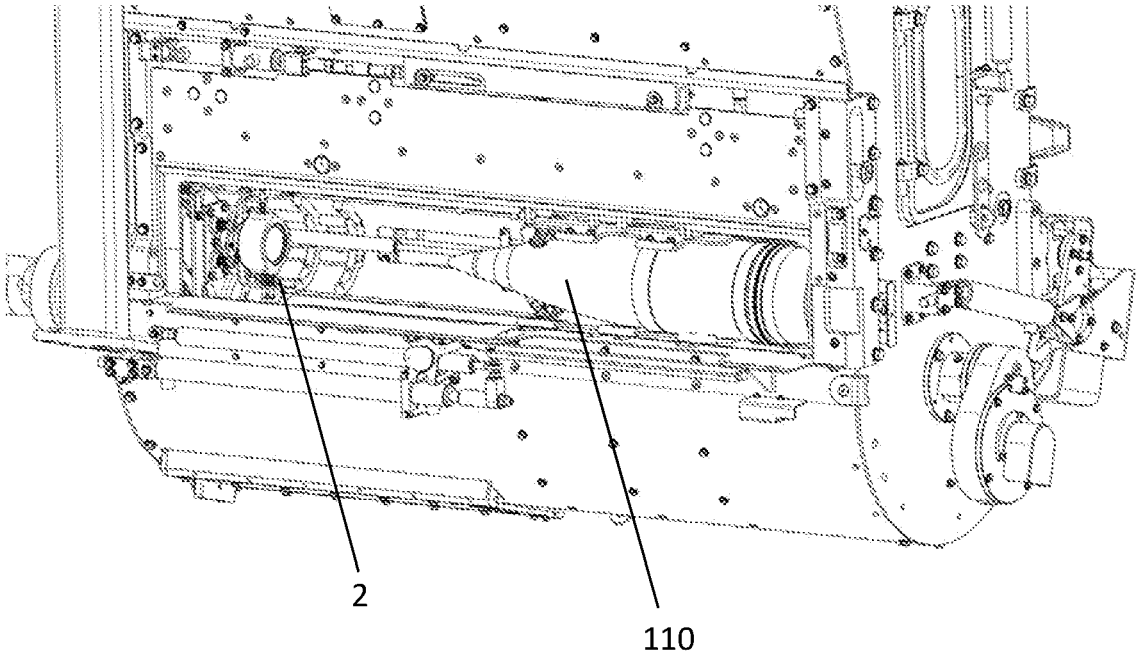
FIG. 5 shows an arrangement similar to FIG. 4 where the fuze setter has been retracted or will be conveyed to an inductive coupling position.

FIG. 5 shows a similar view as FIG. 4 where the setter coil has not yet been inductively coupled to the projectile. When the programming of the fuze of the projectile is completed, the fuze setter 2 is moved from the programming position to its original position. When the information is transferred to the fuze, the fuze confirms or acknowledges that the information has been transferred. The inductive coils arranged in the fuze setter 2 and in the fuze of the projectile communicate reciprocally. A specific transmitter coil and a specific receiver coil may also be arranged in the fuze setter 2 and a specific transmitter coil and a specific receiver coil could be arranged in the fuze of the projectile.

Figure 6:
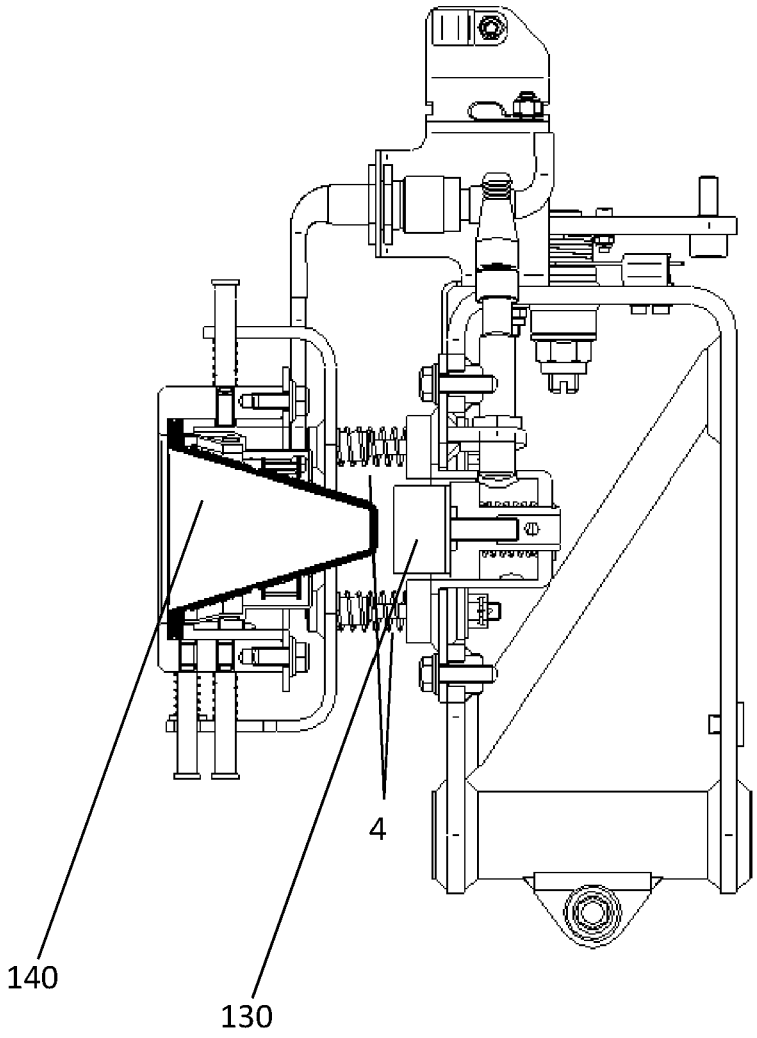
FIG. 6 shows a side view of the guiding arrangement where the projectile and the fuze setter are not positioned in an inductive coupling position.
Figure 7:
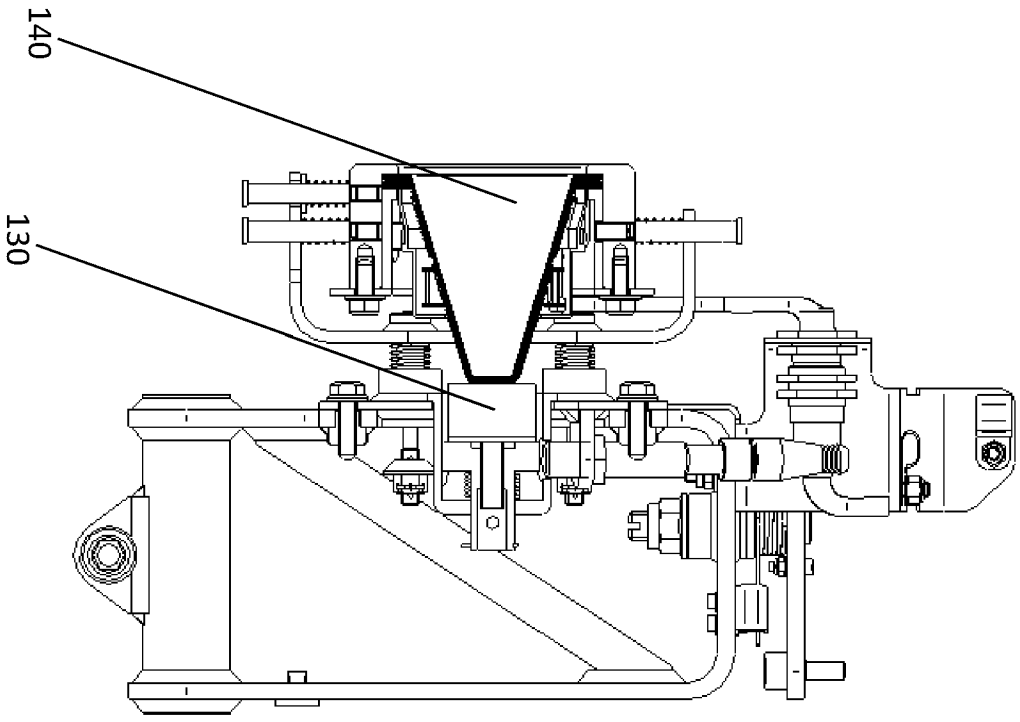
FIG. 7 shows a side view of the guiding arrangement similar to FIG. 6 where the projectile and the fuze setter are in an inductive coupling mode.

FIGS. 6 and 7 show docketed and undocketed projectiles 110, i.e. in an inductive coupling position. In FIG. 6, the fuze setter 2 is moving towards the projectile 110. The fuze 140 of the projectile 110 is contacting the fuze setter 2 resulting in compression of resilient means 4 consisting of or comprising coil springs. In FIG. 7, resilient means 4 are compressed and the contact switch 130 is activated and the movement of the fuze setter 2 towards the projectile is stopped. The contact switch 130 could be an electromechanical switch or other sensor, such as a capacitive, optical, magnetic or other type of sensor.

When the contact switch 130 is activated, a signal is communicated to the controller of the programming device indicating that programming could begin. Information is electrically communicated to a transmitter coil of the fuze setter 2. The control electronics convert the information to be sent to the projectile fuze to an electrical signal according to specifications of the inductive transmitter coil. When the electrical signal is transmitted to the fuze setter 2, a magnetic field is created in the transmitter coil. The receiver coil located in the projectile fuze 140 detects or receives the magnetic field and the magnetic field induces an electrical current in the receiver coil. The fuze electronics in the projectile detects the electrical current and decodes the information. A product for inductively programming fuzes known in the art is the Enhanced Portable Inductive Artillery Fuze Setter (EPIAFS), and known methods for inductive programming of fuzes are known from standard documents such as STANAG-4369 Design Requirements for Inductive Setting of Electronic Projectile Fuzes, and AOP-22 Design Criteria and Test Methods for Inductive Setting of Electronic Projectile Fuzes.

The invention claimed is:

1. Method of inductively programming a fuze comprising at least one target coil arranged in a projectile by means of a fuze setter comprising at least one setter coil, the method comprising i) conveying at least one of a projectile or a fuze setter by means of actuating means to bring the at least one target coil and the at least one setter coil in an inductive coupling position, ii) programming the fuze by transferring predetermined fuzing data from the at least one setter coil to the at least one target coil, iii) transferring fuzing data from the at least one target coil to the at least one setter coil to confirm correct programming of the fuze has been performed, and iv) retracting at least one of the fuze setter or projectile from the inductive coupling position when the transfer of fuzing data has been completed, wherein at least one sensor is arranged to monitor conveying of at least one of the fuze setter or the projectile to provide the inductive coupling position, and wherein the inductive programming is performed in a magazine.

2. Method according to claim 1, wherein the at least one setter coil transfers electrical energy to the at least one target coil.

3. Method according to claim 1, wherein the fuze setter and fuze are concentrically positioned in the inductive coupling position.

4. Method according to claim 1, wherein the at least one setter coil embraces the at least one target coil in the inductive coupling position.

5. Method according to claim 1, wherein the setter coil is retracted subsequent to completion of transfer of the fuzing data.

6. Method according to claim 1, wherein the actuating means is powered by means of a hydraulic system.

7. Method according to claim 1, wherein the at least one setter coil and/or target coil is conveyed substantially horizontally to the inductive coupling position.

8. Method of inductively programming a fuze comprising at least one target coil arranged in a projectile by means of a fuze setter comprising at least one setter coil, the method comprising i) conveying at least one of a projectile or a fuze setter by means of actuating means to bring the at least one target coil and the at least one setter coil in an inductive coupling position, ii) programming the fuze by transferring predetermined fuzing data from the at least one setter coil to the at least one target coil, iii) transferring fuzing data from the at least one target coil to the at least one setter coil to confirm correct programming of the fuze has been performed, and iv) retracting at least one of the fuze setter or projectile from the inductive coupling position when the transfer of fuzing data has been completed, wherein at least one sensor is arranged to monitor conveying of at least one of the fuze setter or the projectile to provide the inductive coupling position, and wherein the projectile is positioned in a holder of a magazine prior to and during programming of fuze and, when the transfer of fuzing data has been completed, the projectile comprising the fuze is ejected from the holder.

9. Method according to claim 1, wherein the projectile is positioned with its nose portion horizontally in a horizontal holder in a magazine.

10. Method according to claim 1, wherein a gun computer program monitors the actuating means.

11. Method according to claim 1, wherein the projectile is transported by means of actuating means comprising a guiding arrangement to an inductive coupling position.

12. Method of inductively programming a fuze comprising at least one target coil arranged in a projectile by means of a fuze setter comprising at least one setter coil, the method comprising i) conveying at least one of a projectile or a fuze setter by means of actuating means to bring the at least one target coil and the at least one setter coil in an inductive coupling position, ii) programming the fuze by transferring predetermined fuzing data from the at least one setter coil to the at least one target coil, iii) transferring fuzing data from the at least one target coil to the at least one setter coil to confirm correct programming of the fuze has been performed, and iv) retracting at least one of the fuze setter or projectile from the inductive coupling position when the transfer of fuzing data has been completed, wherein the projectile is positioned in a holder of a magazine prior to and during programming of the fuze and when the transfer of fuzing data has been completed, the programmed projectile comprising fuze is ejected from the holder.

13. Method according to claim 12, wherein the at least one setter coil transfers electrical energy to the at least one target coil.

14. Method according to claim 12, wherein the fuze setter and fuze are concentrically positioned in the inductive coupling position.

15. Method according to claim 12, wherein the at least one setter coil embraces the at least one target coil in the inductive coupling position.

16. Method according to claim 12, wherein the setter coil is retracted subsequent to completion of transfer of the fuzing data.

17. Method according to claim 12, wherein the actuating means is powered by means of a hydraulic system.

18. Method according to claim 12, wherein the at least one setter coil and/or target coil is conveyed substantially horizontally to the inductive coupling position.

* * * * *